US005520140A

United States Patent [19]

Szukhent, Jr.

[11] Patent Number: 5,520,140

[45] Date of Patent: May 28, 1996

[54] JAW SLIDE

[76] Inventor: Steve Szukhent, Jr., 3475 Williamson, Saginaw, Mich. 48601

[21] Appl. No.: 219,078

[22] Filed: Mar. 28, 1994

[51] Int. Cl.[6] ..... B63B 17/00

[52] U.S. Cl. ..... 114/362

[58] Field of Search ..... 114/361, 343; 135/88

[56] References Cited

U.S. PATENT DOCUMENTS

| | | | |
|---|---|---|---|
| 2,393,203 | 1/1946 | Tarbell et al. | 308/121 |
| 2,513,764 | 7/1950 | Vonder Ahe | 114/361 |
| 2,927,809 | 3/1960 | Smelko | 287/20 |
| 3,329,455 | 7/1967 | Becker et al. | 287/92 |
| 3,352,582 | 11/1967 | Mankin et al. | 287/89 |
| 3,419,942 | 1/1969 | Dunklee | 24/19 |
| 4,582,016 | 4/1986 | Hansen | 114/361 |
| 4,926,782 | 5/1990 | Lacy | 114/361 |
| 4,938,623 | 7/1990 | Alexander | 403/45 |
| 5,016,558 | 5/1991 | Oehler | 114/361 |
| 5,303,667 | 4/1994 | Zirkelbach et al. | 114/361 |

*Primary Examiner*—Stephen Avila
*Attorney, Agent, or Firm*—John J. Swartz

[57] ABSTRACT

Jaw slide apparatus for releasably holding relatively moveable frame bars of a collapsible and extensible frame, such a convertible top boat frame in spaced apart positions. The jaw slide includes a slide bushing received on one of the frame bars for axial sliding movement thereon as the bars are moved toward and away from each other. A bearing mounts on the slide bushing for rotation relative thereto as the bushing slides along the bar.

40 Claims, 3 Drawing Sheets

JAW SLIDE

BACKGROUND OF THE INVENTION

1. Field of the Invention

This invention relates to a jaw slide for coupling and holding portions of a moveable frame and more particularly to apparatus for coupling swingable frame members, which are rectangular in cross-section, of a collapsible and extensible convertible boat top frame.

2. Description of the Prior Art and Objects

Frame structures for supporting a flexible material for a marine vehicle convertible roof to protect a vehicle occupant area have been provided heretofore. U.S. Pat. No. 4,582,016 issued to Gerold B. Hansen on Apr. 15, 1986 and U.S. Pat. No. 4,926,782 issued to Franklin R. Lacey on May 22, 1990 are illustrative of such boat top canopies. The prior art frame structures typically include a plurality of inverted U-shaped, hollow, tubular frame members which are pivotally coupled to each other for relative swinging movement between collapsed positions, when the convertible top is down, and spread positions, when the convertible top is up.

Apparatus has been provide heretofore for releasably holding the U-shaped tubular boat frame members in the spread or extended positions and have included a plurality of rigid spreaders which span the uppermost cross bars of the inverted U-shaped frame bar members.

The opposite ends of each prior art spreaders are coupled to the uppermost cross-bars via slides which have round or circular openings therethrough for receiving and sliding frame bars which are circular in cross-section. The prior art slides are pivotally coupled to opposite ends of each spreader bar. As the frame bars are swung toward and away from each other, the prior art slides, which are pivotally coupled to the frame bar, axially slide along the round boat frame bars to which they are coupled. As the prior art slides are longitudinally moved on the frame bars, the spreader bar also rotates relative to the slide and the round frame bars.

Flaccid straps have been utilized to couple boat top frame members together but such straps do not slide along the boat frame members as they are swung.

It has been found desireable to utilize boat frame members which are rectangular, and preferrably square, in cross-section. The prior art slides, which include circular apertures therethrough, cannot be utilized on tubular frame bars having rectangular cross sections. Merely manufacturing the prior art slides with square apertures does not solve the problem because the slide must be constructed so as to allow the spreader bar to rotate relative to the convertible tubular frame bars as it slides along the frame bar. Accordingly, it is an object of the present invention to provide a slide adapted to a frame bar which is non-circular in cross-section.

It is another object of the present invention to provide a slide for releasably coupling a swingable frame bar, which is rectangular in cross-section.

It is a further object of the present invention to provide a jaw slide having a bushing provided with a non-circular opening therethrough for slidably receiving a moveable frame member having a non-circular cross-section and a bearing member journalling the bushing for rotation relative thereto.

It is yet another object of the present invention to provide a spreader for releasably holding relatively swingable convertible top frame members, having a square cross-section, in spread positions but being slideable thereon to allow the frame members to collapse.

It is a further object of the present invention to provide jaw slide apparatus of the type described including a bushing which includes a pair of semi-cylindrical tubes having opposing, semi-rectangular openings therethrough for slidably receiving a rectangular frame part of a convertible boat top or the like.

It is another object of the present invention to provide a jaw slide including a coupling member having a pair of jaws disposed on opposite sides of a bearing provided with a non-circular opening therethrough that slidably receives a swingable frame bar.

Other objects and advantages of the present invention will become apparent to those of ordinary skill in the art as the description thereof proceeds.

SUMMARY OF THE INVENTION

Jaw slide apparatus for securing a part of a swingable frame member, such as a convertible top fabric supporting frame, comprising a slide for slidably receiving a part of the frame and a bearing mounted on the slide bushing for rotation relative thereto.

DESCRIPTION OF THE DRAWINGS

The invention may be more readily understood by referring to the accompanying drawings, in which.

DESCRIPTION OF THE PREFERRED EMBODIMENT

Figure 1:
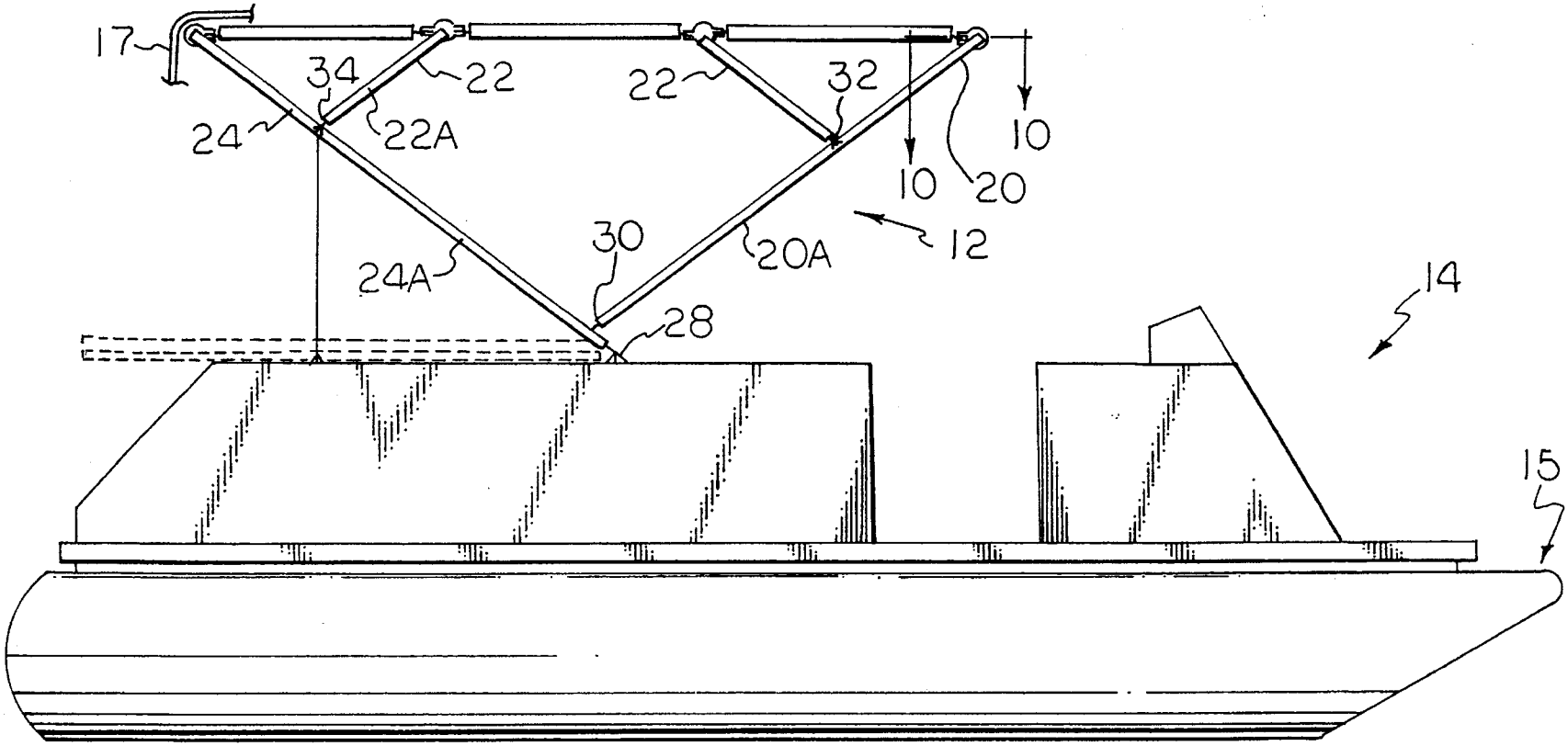
FIG. 1 is a side elevational view of a boat including a convertible top frame having frame members swingably coupled together releasably held in the spread positions illustrated with jaw slide apparatus constructed according to the present invention.

The jaw slide, generally designated 10, constructed according to the present invention, is particularly adapted for use with a convertible top frame, generally designated 12, provided on a boat, generally designated 14, having a hull, generally designated 15. The frame 12 is swingably mounted on the hull 15 for swinging movement thereon between the exended position, illustrated in solid lines in FIG. 1, and a collapsed or stowed position, illustrated in chain lines in FIG. 1. A fabric, such as canvas, schematically designated 17, covers the frame 12 as usual.

Figure 7:
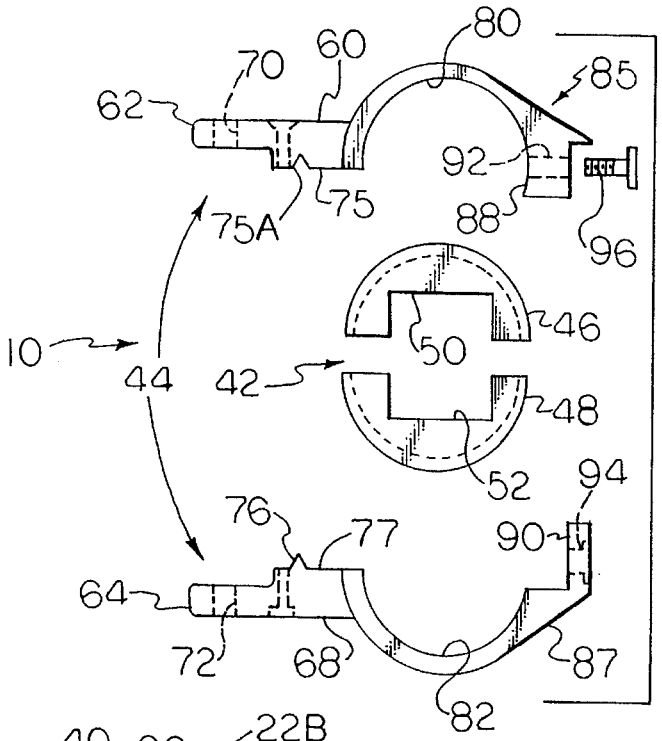
FIG. 7 is an enlarged exploded side elevational view of the jaw slide illustrated in FIGS. 3 and 4.
Figure 7A:
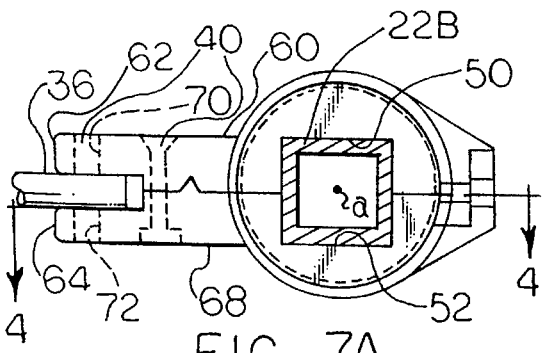
FIG. 7A is an enlarged sectional end view of a jaw slide mounted on a tubular frame member, taken along the line 7A—7A of FIG. 2.

The frame 12 is conventional and includes upstanding, angularly arranged, forward, intermediate, and rearward, inverted, U-shaped tubular bows 20, 22 and 24. The bows 20, 22 and 24, which may suitably comprise hollow aluminum tubing, are rectangular and preferably square in cross-section as illustrated in FIG. 7A. The bows 20, 22 and 24 include pairs of laterally spaced, vertical side posts 20A, 22A and 24A, respectively, spanned by horizontal, upper cross bars 20B, 22B and 24B, respectively. The rearward bow 24 is sometimes referred to as the primary bow. The lower ends 26 of the primary vertical side posts 24A are pivotally mounted on the hull 15 via hinge pivot members 28, as usual. The vertical side posts 20A of the front or secondary frame member 20, which are shorter than the primary vertical side posts 24A, are pivotally mounted on the primary posts 24*a* via hinge pivots, schematically designated 30. The intermediate, relatively shorter, inverted U-shaped mid-bow 22 is pivotally mounted on each of the front and rear bows 20 and 24 via pivots, schematically designated 32 and 34. The frame 12 is collapsible and extensible between the extended spread positions, illustrated in solid lines in FIG. 1, and the collapsed, folded positions, illustrated in chain lines in FIG. 1, in which all of the bows are stacked side-by-side adjacent the hull 15.

The apparatus constructed according to the present invention includes a plurality of spreaders, generally designated 36, which span adjacent ones of the top frame cross bars 20B, 22B and 24B. Each spreader 36 includes a central tube 38 pivotally coupled at opposite ends 36A and 36B, via pivot pins 40, to jaw slides 10 constructed according to the present invention.

Figure 4:
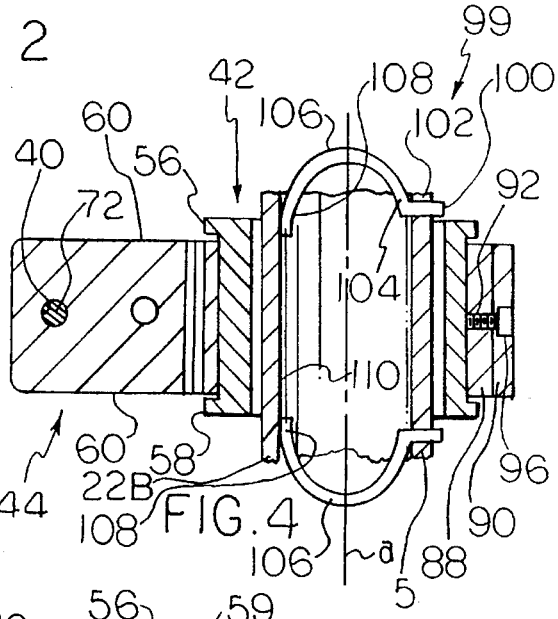
FIG. 4 is an enlarged sectional plan view of the jaw slide, taken along the line 4—4 of FIG. 7A.
Figure 5:
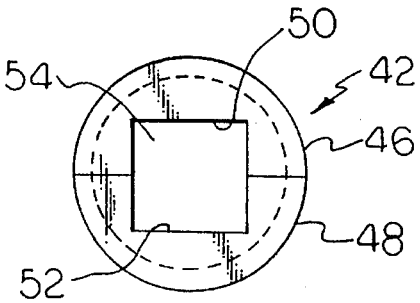
FIG. 5 is an enlarged end elevational view of a slide bushing only included in the jaw slide illustrated in FIGS. 3 and 4.
Figure 6:
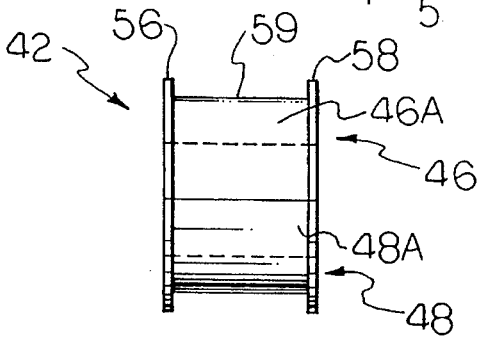
FIG. 6 is an enlarged end view of the slide bushing, taken from the right side of FIG. 5.

Each jaw slide 10 includes a slide bushing, generally designated 42, and a journal box, generally designated 44. The slide bushing 42 includes upper and lower, confronting, mating hubs 46 and 48 which externally are semi-cylindrical and include semi-cylindrical outer surfaces 46A and 48A but internally are provided with opposing, semi-square cut outs 50 and 52, respectively, for slidably receiving one of the top, square, cross-bar tubular members 20B, 22B and 24B. When assembled, as illustrated in FIGS. 4 and 7A, the semi-square cut outs 50 and 52 provide a generally square opening 54 which is complementally shaped to the square cross-section of the top frame cross bars 20B, 22B, 22C. The size of each opening 54 is such as to allow each slide bushing 42 to slide laterally or axially on the bars 20B, 22B and 24B as the frame members 20, 22 and 24 swing between the positions illustrated in solid lines and chain lines in FIG. 1.

The semi-cylindrical slide bushing hubs 46 and 48 of each jaw slide 10 include integral, axially spaced, radially outwardly extending, semi-cylindrical flanges 56 and 58, respectively, which bear against axially opposite ends 60 of the journal box 44 to preclude relative axial movement therebetween. The semi-cylindrical hub surfaces 46A and 48A and the flanges 56 and 58 define an annular groove or race 59.

Each journal box 44 comprises upper and lower jaws 62 and 64 having portible mounting arms 66 and 68, respectively, for receiving therebetween one end of a spreader bar 36. The arms 66 and 68 include vertically aligned apertures 70 and 72, respectively, for receiving a spreader bar pivot pin 40. The upper arm 66 includes an inner mating surface 75 having a dovetail slot 75A for receiving a complementally shaped, dovetail tang or locating projection 76 provided on the confronting inner mating surface 77 of the confronting lower arm 68 to keep the upper and lower mounting arms 66 and 68 aligned and prevent them from wisting relative to each other about an axis normal to the longitudinal axes a of the tubes 20B, 22B and 24B.

The upper and lower jaws 62 and 64 include semi-cylindrical hubs 85 and 87, respectively, defining semi-cylindrical recesses 80 and 82, respectively, which are received in the annular groove or race 59 defined by the semi-cylindrical slide bushing flanges 56 and 58. The hub portions 85 and 87, defining the semi-cylindrical recesses 80 and 82, comprise a tooth which is received by the slide bushing annular groove or race 59. The portions 85 and 87 provide an internal ring or seat which journals the slide bushing 42 for relative rotation about the axes a of the cross bars 20B, 22B and 24B as the frame members 20, 22 and 24 are swung relative to each other. As the frames 20, 22 and 24 are swung relative to each other, the slide bushing 42 will not rotate relative to the upper cross bars 20B, 22B and 24B, however, the slide bushings will be forced to rotate therewith relative to the hubs 85 and 87 which will rotate about the axes a.

The upper and lower jaws 62 and 64 also include overlapping terminal end portions 88 and 90, respectively, including aligned apertures 92 and 94, respectively, for receiving a self-threading locking screw 96. The slide bushing 42 and the journal box 44 may suitably comprise non-corrosive nylon.

Figure 2:
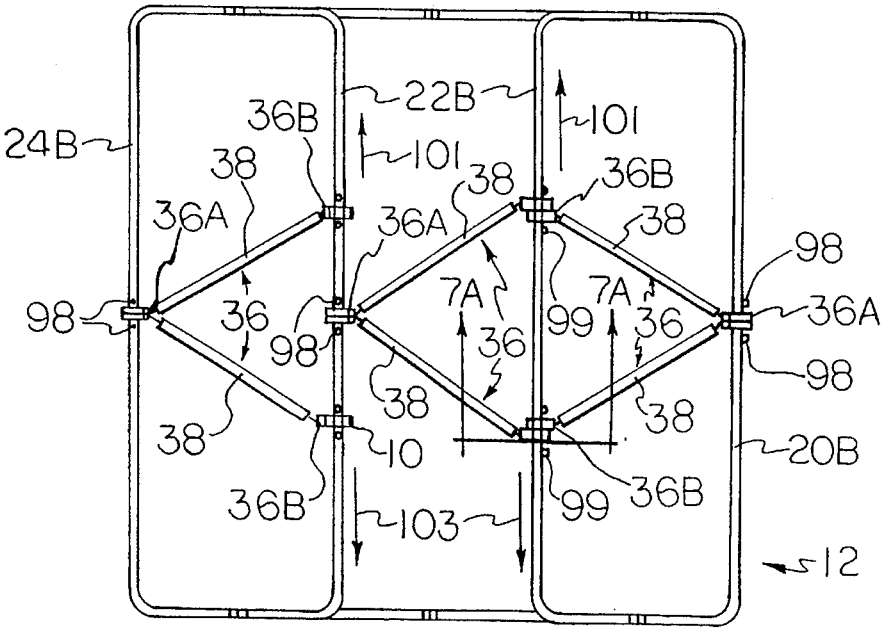
FIG. 2 is a top plan view of only the boat frame, illustrated in FIG. 1, and the spreader apparatus constructed according to the present invention mounted thereon.
Figure 3:
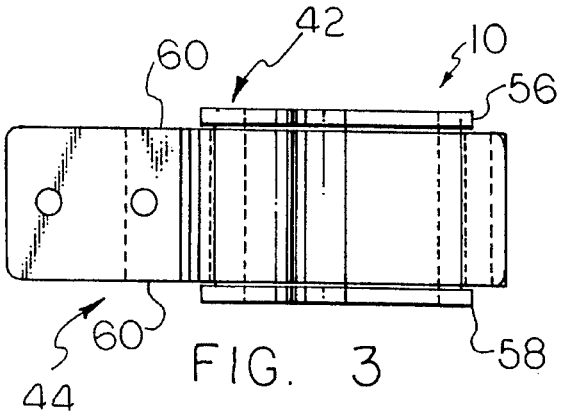
FIG. 3 is an enlarged top plan view of a jaw slide which is constructed according to the present invention and coupled to each end of each spreader bar.

As illustrated in FIG. 2, a pair of the spreaders 36 span the rear top cross bar 24B and the adjacent mid top cross bar 22B, another pair of spreaders 36 span the pair of mid top cross-bars 22B, and a third pair of spreaders span the front, top cross bar 24B and the adjacent mid-top bar 22B. It is important to note that the jaw slide 10 coupled to one end 36A of each spreader arm 36 is relatively axially close to an axially adjacent end 36A of an adjacent spreader arm 36 and precluded from axial movement relative to the bars 20B, 22B and 24B via stop members comprising screws, generally designated 98, threaded into, but projecting from, the from and rear top cross bars 20B and 24B and the rear one of the two mid-top cross bars 22B. It is also important to note that the jaw slides 10 coupled to the opposite ends 36B of each spreader bar 36 are normally axially spread apart relative to an adjacent end 36B of a laterally adjacent one of each pair of spreaders, as illustrated in FIG. 2, and are moveable axially outwardly to further spread positions, in the axially opposite directions of the arrows 101 and 103, as the bars 20, 22 and 24 are swung to the collapsed positions.

Stop members, generally designated 99 (FIG. 4), are provided for detachably axially holding the jaw slides 10, coupled to spreader arm ends 36B, in the positions illustrated in FIG. 2. Each stop member 99 includes a pair of depressable spring loaded push buttons 100 located on axially opposite ends of each slide bushing 42 (FIG. 4). The push buttons 100 are received in openings 102 provided in the robes 20B, 22B and 24B. The push buttons 100 are fixed to an arm 104 of a spring 106 having an opposite end 108 fixed to an inner walls 110 of the hollow aluminum robes 20B, 22B and 24B.

The jaw slides 10 coupled to the ends 36A of spreader 36 are detachably precluded from axial sliding movement by the stop screws 98 on axially opposite sides of the adjacent bushings 42 to axially anchor one end 36A of each spreader 36. As the frame members 20, 22 and 24 are moved toward each other, the ends 36A of the spreader bars 36 will remain axially fixed and will force the jaw slides 10, coupled to the opposite ends 36B, to move outwardly, in axially opposite directions, representated by the arrows 101 and 103 to positions adjacent the vertical side posts 22A. When the frame 12 is extended or expanded so that the bars 20B, 22B and 24B are again moved to the open or spread positions illustrated in solid lines in FIG. 2, the jaw slides 10, coupled to the ends 36B of spreaders 36, will move laterally inwardly in the axially opposite directions, opposite the arrows 101 and 103.

Figure 8:
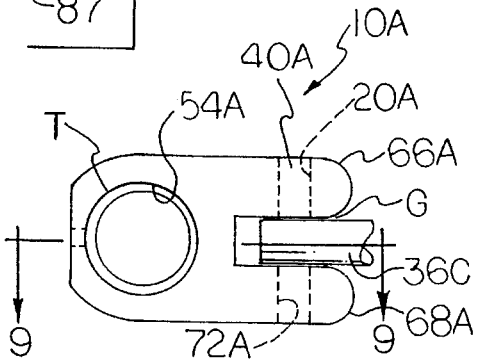
FIG. 8 PRIOR ART
FIG. 8 is a side elevational view of a prior an jaw slide.
Figure 9:
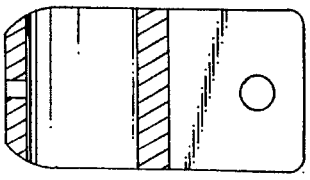
FIG. 9 PRIOR ART
FIG. 9 is a sectional plan view of the prior art jaw slide, taken along the line 9—9 of FIG. 8.
Figure 10:
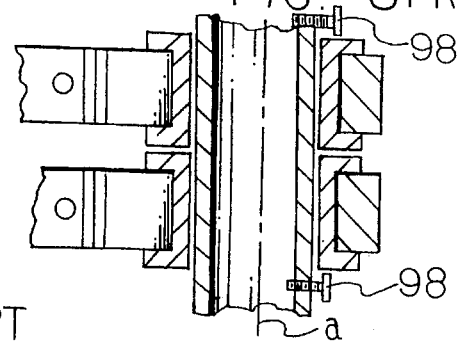
FIG. 10 is a sectional plan view taken along the line 10—10 of FIG. 1.

A prior art slide 10A is illustrated in FIGS. 8 and 9 and includes a unitary construction having a round or circular cylindrical opening 54A therein for receiving a round frame tube T. The slide 10A includes bifurcated spaced apart coupling ends 66A and 68A, spaced apart by a gap G, for receiving a spreader arm 36C. Aligned apertures 70A and 72A are provided in the coupling arms 66A and 68A for receiving a coupling pin 40A.

THE OPERATION

It will be assumed that the boat top frame parts are initially in the spaced or spread positions, illustrated in FIGS. 1 and 2, with the spreader members 36 releasably holding the U-shaped frame bars 20, 22 and 24 in the spread positions. The screws or stops 98 preclude the jaw slides 10, coupled to the spreader bar ends 36A, from axially spreading. The frame held stop buttons 99 axially restrict or hold the jaw slides 10, coupled to the spreader bar ends 36B, from sliding axially.

When it is desired to collapse the convertible top roof, the axially outer ones of the stop buttons 99 on upper cross bars 22B are depressed to a position flush with the outer surfaces S (FIG. 4) of tubes 22B so that the slide bushings 42 mounted thereon can pass over the recessed buttons 99, in the axially outer directions represented by the arrows 101 and 103. The frames 20, 22 and 24 are then swung relatively together, in the directions represented by the arrows X and Y, forcing the jaw slides 10 coupled to the spreader bar ends 36B to be moved laterally outwardly on the bars 22B to further axially spaced positions adjacent the vertical side posts 22A. The entire boat top frame assembly 12 can then be swung downwardly to the stowed position, illustrated in chain lines in FIG. 1.

The spreader bars 36 in each pair of spreader bars 36 spanning the same two top cross bars 20B, 22B and 24B are always inclined relative to teach other and relative to the top frame bars 20B, 22B and 24B and are angularly offset relative to each other and to the jaw slides 10 at opposite ends thereof so as never to be in the same vertical plane. This construction allows the spreader bars 36 and jaw slides 10 to easily be mounted to other boat top frames which may have slightly differing dimensions.

When it is desired to again raise the boat top frame 12, the frame bars 20, 22 and 24 are swung opposite the directions of the arrows X and Y relative to each other to the spread positions illustrated in solid lines in FIGS. 1 and 2. The jaw slides 10, coupled to the ends 36B on cross bars 22B will be forced axially inwardly toward each other, opposite the directions of the arrows 101, 103. The axially outer jaw buttons 99 are again depressed to allow the jaw slides 10, coupled to ends 36B, to return to the positions illustrated in FIG. 2. When the jaw slides 10 coupled to spreader ends 36B again pass over the axially inner stop buttons 99, the springs 106 will radially force the axially outer stop buttons 99 to "pop out" to the stopping positions illustrated in FIG. 4.

As the jaw slides 10, mounted on spreader bar ends 36B, axially slide inwardly and outwardly on the frame bar tops 22B, the journal boxes coupled thereto will rotate relative to the slide bushings 42 associated therewith so that the frame bars 20, 22 and 24 do not bind but can be freely and easily extended or collapsed.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. In a convertible top for a boat hull comprising:

frame means for supporting a flexible roof material including a first, inverted U-shaped frame having a first pair of upstanding legs, swingably mounted on said hull, spanned by a base;

a second, inverted U-shaped frame having a second pair of upstanding legs spanned by a base;

means linking said second frame to said first frame for relative swinging movement, between collapsed, relatively closed positions, in which said bases are adjacent each other, and extended, spread positions in which said bases are spaced apart from each other; and coupling means, spanning said bases, including opposite ends coupled to said bases, at least one of said ends being slidably mounted on one of said bases when said first and second frames move between said collapsed closed positions and said extended spread positions;

and wherein at least said one base comprises a non-circular cross-section; and at least said one end of said coupling means comprises slide means, slidably received on said one base, but allowing said first and second frames to be relatively swung between said closed and spread positions.

2. In a convertible top set forth in claim 1 wherein said slide means comprises a tubular member; and a bushing slidably receiving said one base and being journaled in said tubular member for relative rotation when said first and second frames move between said extended positions and said collapsed positions.

3. The convertible top set forth in claim 2 wherein said bushing includes an internal bore having a cross-section complementally shaped to the said non-circular cross-section of said one base.

4. The convertible top set forth in claim 3 wherein said bushing comprises a pair of semi-cylindrical tubes disposed in confronting relation on opposite sides of said one base.

5. The convertible top set forth in claim 4 wherein said pair of semi-cylindrical tubes include opposing, non-circular opposed openings on opposite sides of said one base.

6. The convertible top set forth in claim 3 wherein said bushing includes an annular, external slot, said tubular member including an annular internal tooth slidably received by said slot for guiding rotational movement of said tubular member on said bushing.

7. The convertible top set forth in claim 6 wherein said tubular member includes partible portions and means detachably coupling said partible portions together on opposite sides of said semi-cylindrical tubes.

8. The convertible top set forth in claim 5 wherein said tubular member comprises a plurality of partible members detachably coupled together.

9. The convertible top set forth in claim 8 wherein said one base has a rectangular cross-section.

10. The convertible top set forth in claim 1 wherein said means linking said second frame to said first frame for relative swinging movement includes means pivotally mounting said first pair of upstanding legs on said second pair of upstanding legs.

11. Jaw slide apparatus for securing an elongate bar, such as a convertible top frame, to an object, said bar having a longitudinal axis, said apparatus comprising:

slide bushing means for slidably receiving said bar for axial sliding movement on said bar; and means for coupling said slide bushing means to an object including bearing means mounting said slide bushing means for rotation relative thereto.

12. The jaw slide apparatus set forth in claim 11 wherein said bearing means comprises first and second opposing jaw means on opposite sides of said slide bushing means, and means for detachably coupling said first and second jaw means to each other.

13. The jaw slide apparatus set forth in claim 11 wherein said slide bushing means comprises first and second hubs disposed in confronting relation for slidably receiving opposite sides of said bar.

14. The jaw slide apparatus set forth in claim 11 wherein said bearing means and said slide bushing means includes radially extending flange means for precluding relative axial movement of said bearing means and said slide bushing means.

15. The jaw slide apparatus set forth in claim 14 wherein said bearing means comprises first and second opposed jaw means disposed in confronting relation on opposite sides of said slide bushing means; and means for detachably coupling said first and second jaw means to each other.

16. The jaw slide apparatus set forth in claim 15 wherein said flange means extends radially outwardly of said slide bushing means on axially opposite sides of said first and second jaw means.

17. The jaw slide apparatus set forth in claim 15 wherein said first and second opposed jaw means include overlapping terminal end portions; said means for detachably coupling including fastener means coupling to said overlapping terminal end portions.

18. The jaw slide apparatus set forth in claim 12 wherein said slide bushing means comprises first and second, substantially identical, bushing half sections which are detachably disposed in abutting relation with each other.

19. The jaw slide apparatus set forth in claim 18 wherein said bushing half sections cooperate to define a transverse passage which is noncircular in cross section.

20. The jaw slide apparatus set forth in claim 19 wherein said cross section of said transverse passage is rectangular.

21. Jaw slide apparatus for coupling a swingable longitudinal extending bar, such as a convertible top frame member having an elongate axis and a predetermined cross-sectional shape, which is swingably mounted for movement in a to-and-fro path of travel relative to an object, such as another convertible top frame member, comprising:

slide bushing means, having an internal, axial, transverse passage therethrough, adapted to complement the cross-sectional shape of said bar, for slidably receiving said bar for axial sliding movement on said bar as said bar is swung; and means for coupling said slide bushing means to said object including journal means journalling said slide bushing means for rotation relative thereto about said axis as said slide bushing means moves axially.

22. The jaw slide apparatus set forth in claim 21 wherein said journal means comprises first and second jaws having inner surfaces disposed in confronting relation; a substantially semi-cylindrical recess at one end of each of said jaws disposed in confronting relation with the semi-cylindrical recess in the other jaw to form a cylindrical recess in which said slide means is rotatably received.

23. The jaw slide apparatus set forth in claim 21 wherein said one of said slide means and said journal means includes an annular slot and the other of said slide means and said journal means includes a notch received by said slot for guiding the rotational movement of said journal means on said slide means.

24. The jaw slide apparatus set forth in claim 21 wherein said slide means includes axially spaced apart, radially outwardly extending flange means for precluding relative axial movement of said slide means and said journal means.

25. The jaw slide apparatus set forth in claim 21 wherein said passage in said slide means is rectangular.

26. The apparatus set forth in claim 25 wherein said passage is square.

27. The jaw slide apparatus set forth in claim 21 wherein said slide means includes first and second confronting sections each having an inner surface provided with a partial rectangular recess disposed therein and an outer semi-cylindrical surface; said partial rectangular recesses being disposed in confronting relation to each other to define a rectangular recess for receiving a rectangular bar.

28. The jaw slide apparatus set forth in claim 27 wherein said journal means comprises first and second jaws having inner surfaces disposed in confronting relation; a substantially semi-cylindrical recess at one end of each of said jaws disposed in confronting relation with the semi-cylindrical recess in the other of said jaws to form a cylindrical recess which receives said outer semi-cylindrical surfaces on said first and second sections of said slide means.

29. In combination:

a collapsible and extensible frame, such as a convertible top boat frame, for supporting a flexible covering, said frame including a first longitudinally extending frame bar;

a second longitudinally extending frame bar;

said frame bars having generally parallel longitudinal axes; and means mounting said frame bars for relative movement toward and away from each other, between closed positions, adjacent each other, and spread positions, displaced from each other while maintaining said bars in parallel relation;

spreader means for coupling and detachably holding said first and second bars in said spread positions including slide bushing means slidingly received on at least said first bar for axial sliding movement between an axially outer position, when said bars are in said closed positions, and an axially inward position when said bars are in said spread positions; and bearing means mounting said slide bushing means for rotation relative thereto when said slide bushing means axially moves between said axially inward position and said axially outer position.

30. The combination set forth in claim 29 wherein said slide bushing means includes an annular slot receiving said bearing means.

31. The combination set forth in claim 29 wherein one of said slide bushing means and said bearing means includes radially extending flange means precluding relative axial movement of said slide bushing means and said bearing means.

32. The combination set forth in claim 31 wherein said slide bushing means includes a pair of axially spaced, radially outwardly extending flange means on axially opposite sides of said bearing means.

33. The combination set forth in claim 29 wherein said bearing means comprises first and second jaws disposed on circumferentially opposite sides of said slide bushing means; and means detachably securing said jaws together.

34. The combination set forth in claim 33 wherein said first and second jaws include terminal ends disposed in overlapping relation with each other; said securing means including fastener means detachably secured to said overlapping terminal ends.

35. The combination set forth in claim 29 wherein said spreader means includes additional slide bushing means slidingly received on said second bar for axial sliding movement thereon; and additional bearing means mounting said additional slide bushing means for rotation relative thereto.

36. The combination set forth in claim 35 wherein said spreader means includes means coupling said slide bushing means to said additional slide bushing means.

37. The combination set forth in claim 35 Wherein said coupling means includes a spreader bar having opposite ends pivotally coupled to said bearing means and said additional bearing means.

38. The combination set forth in claim 37 wherein said slide bushing means and said additional slide bushing means on opposite ends of said spreader bar do not lie in the same vertical plane.

39. The combination set forth in claim 35 including stop means for precluding axial movement of said slide bushing means relative to said first frame bar and additional stop means for selectively holding and releasing said additional slide bushing means for axial sliding movement on said second bar.

40. The combination set forth in claim 29 wherein said spreader means includes a spreader bar having first and second ends, said bearing means being coupled to said first end of said spreader bar, and further including additional slide bushing means slidably received on said second longitudinally extending frame bar and additional bearing means coupled to said second end of said spreader bar journalling said additional bearing means.

* * * * *